US009784439B2

(12) United States Patent
Baker

(10) Patent No.: US 9,784,439 B2
(45) Date of Patent: Oct. 10, 2017

(54) SAFETY HOLIDAY LIGHT ASSEMBLY AND METHOD FOR SAFE INSTALLATION FROM THE GROUND

(71) Applicant: David W. Baker, Plain City, UT (US)

(72) Inventor: David W. Baker, Plain City, UT (US)

( * ) Notice: Subject to any disclaimer, the term of this patent is extended or adjusted under 35 U.S.C. 154(b) by 290 days.

(21) Appl. No.: 14/716,674

(22) Filed: May 19, 2015

(65) Prior Publication Data

US 2016/0341375 A1 Nov. 24, 2016

(51) Int. Cl.

| | |
|---|---|
| ***F21S 4/00*** | (2016.01) |
| ***F21V 21/02*** | (2006.01) |
| ***F21S 4/10*** | (2016.01) |
| ***F21S 4/28*** | (2016.01) |
| *F21S 4/20* | (2016.01) |
| *F21V 21/34* | (2006.01) |
| *F21V 21/005* | (2006.01) |
| *F21W 121/00* | (2006.01) |

(52) U.S. Cl.

CPC ..... *F21V 21/02* (2013.01); *F21S 4/10* (2016.01); *F21S 4/28* (2016.01); *F21S 4/20* (2016.01); *F21V 21/005* (2013.01); *F21V 21/34* (2013.01); *F21W 2121/004* (2013.01)

(58) Field of Classification Search

CPC ..... F21S 4/10; F21S 4/20; F21S 4/26; F21S 4/28; F21V 21/34; F21V 21/005; F21V 21/35; A47H 13/01; A47H 13/02; A47H 13/04

USPC ..... 362/391

See application file for complete search history.

(56) References Cited

U.S. PATENT DOCUMENTS

| | | | | |
|---|---|---|---|---|
| 2,147,625 | A * | 2/1939 | Brothers | A47G 25/746 16/87.4 R |
| 2,715,966 | A * | 8/1955 | Tieck | A47H 15/02 104/108 |
| 4,039,263 | A * | 8/1977 | Bassler | E04B 1/1906 403/171 |
| 5,180,223 | A * | 1/1993 | McNamee | B60Q 1/305 362/223 |
| 6,609,813 | B1 * | 8/2003 | Showers | F21V 15/01 362/223 |
| 7,066,618 | B1 * | 6/2006 | Little | F21V 21/08 248/227.4 |
| 8,506,136 | B1 * | 8/2013 | Herdt | F21V 17/007 362/249.09 |
| 2005/0055800 | A1 * | 3/2005 | Meech | A47H 1/10 16/87.4 R |
| 2006/0042673 | A1 * | 3/2006 | Tseng | A47H 13/00 135/117 |
| 2007/0211462 | A1 * | 9/2007 | Dowell | B05B 15/061 362/249.01 |

* cited by examiner

*Primary Examiner* — Bryon T Gyllstrom
*Assistant Examiner* — James Endo
(74) *Attorney, Agent, or Firm* — Steven Rinehart

(57) ABSTRACT

A safety holiday light assembly facilitates installation of holiday lighting to an exterior perimeter of a building from the ground surface. A substantially rigid tube defines a hollow cavity which carries an alignment member comprising a rod and plurality of spheres. Each sphere is detachably affixed via a cantilever to holiday lighting, which is disposed around a perimeter when the alignment member is inserted into the rigid tube. The tube may be color coordinated to match the colors of the building. The tube may form protective seals against external elements.

16 Claims, 11 Drawing Sheets

SAFETY HOLIDAY LIGHT ASSEMBLY AND METHOD FOR SAFE INSTALLATION FROM THE GROUND

FIELD OF THE INVENTION

This invention relates to a safety holiday light assembly that can be installed from a ground surface and more particularly relates to a safety holiday light assembly that facilitates installation of holiday lighting on an exterior perimeter of a building from a ground surface by providing a tube that fastens to an external perimeter of a building.

BACKGROUND

Description of the Related Art

Typically, holiday lights are lights used for decoration during Christmas and other seasonal holidays. The holiday light displays are utilized in many decorative ways, including decking towering holiday trees in public squares, street trees and park trees, adorning lampposts, and other such structures. In many instances, it is popular to outline private homes with such holiday lights.

The celebration of Christmas and other holidays customarily involves displaying strings of electric lights on residential homes. Many home owners use decorative lighting during holidays to show their spirit of an occasion. A popular type of holiday lighting is in a strip form and generally includes individual bulbs attached along an electrical conducting material, i.e. wire. It is common for people to attach these decorative lights outside their homes in shapes and designs reflective of a particular holiday, such as a tree during Holiday. The eaves and roof are popular places for attaching the holiday lighting.

Typically, the light strips are attached to the perimeter of the building using staples or nails that clamp the wire onto a wall or roof. This not only requires tools and is time consuming, but it also creates holes in the structure that can contribute to severe damage by causing leaks. Not all structures and surfaces are capable of supporting staples or slide-on plastic clips.

Furthermore, installation of the holiday lights requires climbing a ladder to reach the eaves and roof. The ladder must maintain balance of the installer during alignment, stapling, and testing of the holiday lights. Sometimes, the installer must actually sit on the roof itself to access the eaves of the building. In many instances, the installer is not an experienced construction worker or light installation technician, but merely a home owner with a shoddy ladder. It is also very time-consuming to install holiday lighting in accordance with traditional means in the art.

Since Holiday falls in the winter, it is common for high winds, snow, and ice to cause a bulb to buttress the ladder, ropes, and shingles on which the installer depends for support. The high winds may also break; either by agitation or by being forced by a gust into the attached rigid structure. Also, since the holiday lights require electricity, encountering moisture and dust can make the circuitry for the holiday lights inoperable.

Thus, it would be advantageous to provide a holiday light assembly that can be safely installed from the ground surface quickly, that may be color coordinated with the external perimeter of a building, that may inhibit access of moisture and contaminants to the circuitry and lights for holiday lights, while also enabling external manipulations of the light bulbs to orient them for a desired ornamental effect.

SUMMARY

From the foregoing discussion, it should be apparent that a need exists for a safety holiday light assembly that can be installed from a ground surface, provides color coordination to match the exterior perimeter and eaves of a building, and inhibits entry of moisture and contaminants into contact with the holiday lighting. A holiday light assembly is provided to facilitate expeditious place of holiday lights on a building, the assembly comprising: one or more cylindrical tubes defining a hollow inner cavity and a slot, the tubes each having a first diameter and a pair of tube termini, wherein the slot extends along the length of the tube; an alignment member comprising a rod and a plurality of spheres, the rod and the plurality of spheres joined at evenly spaced-apart intervals, the alignment member disposed to pass through the cavity along the length of the tube, the at least one sphere configured to attach to a plurality of lighting members, wherein each sphere comprises a cantilever protruding through the slot when the alignment member is within the cavity, each cantilever comprising fastening means for fastening the cantilever to a lighting member.

The assembly of claim 1 may further comprise: at least one terminal cylinder, the at least one terminal cylinder defined by a second diameter, the at least one terminal cylinder configured to detachably couple to the pair of tube termini, at least one tube fastener, the at least one tube fastener defined by a block having an opening, the opening configured to enable passage of the tube, the at least one tube fastener further defined by a flange having at least one fastening hole; a plurality of lighting members having a plurality of holiday lights.

Each sphere may define a blind aperture, the aperture configured to receive the rod. The rod may be affixed to the sphere with adhesive. The cantilever of each sphere may extend outwardly from the cavity of the tube through the slot. The rod may be formed as an integrated piece with the plurality of spheres.

The plurality of lighting members may be fastened to the at least one sphere with a fastener. The tube may be configured to detachably attach to an exterior perimeter of a building.

The exterior perimeter of the building may include at least one member selected from the group consisting of: an eave, a corner, a roof ridge, a window frame, and a door perimeter.

The block of the at least one tube fastener may be affixable to the outer surface of the tube via one of a detachable fastener and adhesive.

The flange of the at least one tube fastener may detachably attach to the exterior perimeter of the building. The tube may be color coordinated to substantially match the exterior perimeter of the building.

The at least one terminal cylinder may substantially match the shape of the pair of tube termini. The at least one terminal cylinder may detachably couple to the pair of tube termini through a threaded engagement.

The plurality of lighting members may include at least one member selected from the group consisting of: light bulbs, light emitting diodes, and light strips.

The at least one fastening hole of the flange may be configured to enable passage of a screw.

A method for expeditiously positioning holiday lighting on the exterior perimeter of a building is also provided, the method comprising: aligning a tube with an exterior perimeter of a building; detachably fastening the tube to the exterior perimeter of the building with at least one tube fastener; passing at least one alignment member through the tube, the at least one alignment member defined by a rod and at least one sphere, the at least one sphere configured to attach to a plurality of lighting members; coupling at least one terminal cylinder to a pair of tube termini on the tube; inserting the rod through the pair of tube termini; at least partially sealing the tube with the at least one terminal cylinder; manipulating the rod, such that the at least one sphere and the plurality of lighting members are disposed to at least partially extend outwardly through the slot; and at least partially sealing the tube with the rod and the plurality of lighting members.

The present invention has been developed in response to the present state of the art, and in particular, in response to the problems and needs in the art that have not yet been fully solved by currently available holiday light assemblies that are exposed to the external moisture and contaminants. Accordingly, the present invention has been developed to provide safety holiday light assembly for detachable attachment to the exterior of a building that overcome many or all of the above-discussed shortcomings in the art.

The safety holiday light assembly is provided with a plurality of modules configured to functionally execute the necessary steps of decoratively lighting the perimeter of the building, while also inhibiting entry of moisture and contaminants through the tube termini and the slot that runs along the length of the tube.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 6A is a frontal view, FIG. 6B is an elevated side view, and FIG. 6C is a lower angle perspective view in accordance with the present invention;

FIG. 7A is a lower angle perspective view, FIG. 7B is an elevated side view, and FIG. 7C is a frontal view in accordance with the present invention;

FIG. 10A is a lower angle perspective view, FIG. 10B is an elevated side view, and FIG. 10C is a frontal view in accordance with the present invention;

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
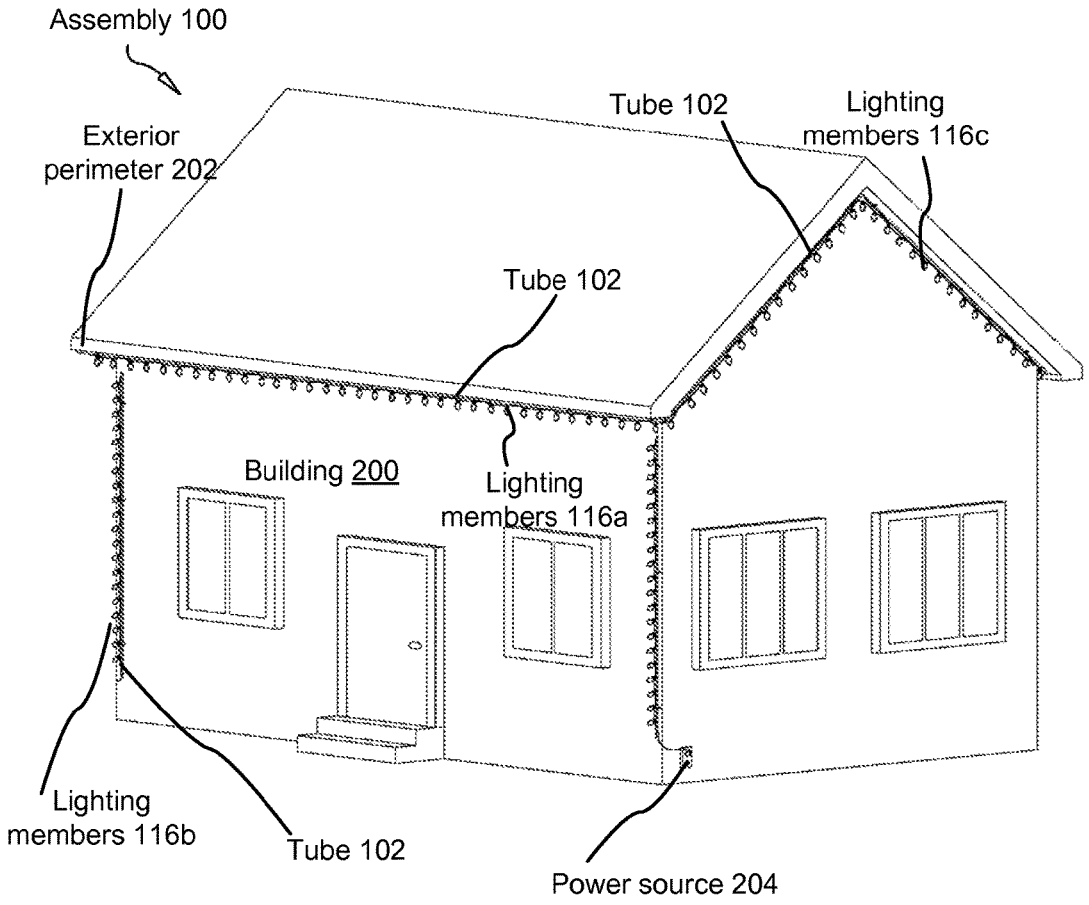
FIG. 1 is a perspective view illustrating one embodiment of a safety Holiday lighting assembly attached to an exterior perimeter of a building in accordance with the present invention.

FIG. 1 depicts a safety holiday light assembly 100, hereafter, "assembly 100" that detachably attaches to an external perimeter 202 of a building 200 for decorative enhancements, such as when celebrating holiday. Beneficially, such an assembly 100 would provide a tube 102 that is detachably fastened to the building 200 through the use of at least one tube fastener 128. The tube 102 can be manipulated against the exterior perimeter of the building 200, including the eaves and roof, and then fastened thereto from the ground surface. In this manner, it is not necessary to climb a ladder or climb on the building to install the assembly 100.

In some embodiments, the assembly 100 decoratively illuminates the exterior perimeter 202 of a building 200. The exterior perimeter 202 of the building 200 may include, without limitation, an eave, a corner, a roof ridge, a window frame, and a door perimeter 202. In another embodiment, the tube 102 may be used on outdoor trees, windows, and roof tops, and even indoors. The assembly 100 may be configured in any desired orientation on the exterior perimeter 202 to achieve a desired decorative effect. The tube 102 may also be color coordinated to match the colors of the building 200. The present invention enables outdoor operation of the assembly 100 without concern for external moisture and contaminants due to the sealing capacity that protects the circuitry within the tube 102.

The tube 102 is defined by an elongate, flexible cylinder shape. The tube 102 has a cavity 108, a pair of tube termini 104*a-b*, an outer surface 110, and a slot 106 that runs along the length of the tube 102. The tube 102 is substantially rigid, and thus, may be aligned along the vertical and horizontal sections of the building 200 from the ground surface. By applying a leveraging force on a tube 102, it aligns along an exterior perimeter 202 of a building 200 from a ground surface. The tube 102 acts much like a lever, whereby a fulcrum, such as an arm, can be used to raise the tube 102 against the selected region of the building 200 for installation.

For example, the tube 102 is aligned to a corner of a building 200 and pivoted upwardly to engage the corner. A fastening device, such as a stapler, with a long handle may then be used to staple the tube 102 to the corner of the building 200. In another example of facilitated installation from the ground surface, the tube 102 is lifted with an elongated tool to align with the eaves on the roof. A stapler with a long handle may then engage the tube 102 to fasten it to the desired location on the building 200. By not requiring climbing on a ladder or on the roof, and providing a rigid, lightweight tube 102 that easy aligns with the exterior perimeter 202 of the building 200, installation of the assembly 100 becomes a substantially safer operation.

The cavity of the tube 102 is sized and dimensioned to carry circuitry for powering a plurality of lighting members 116*a-c*. The lighting members 16*a-c* protrude through the slot 106 to illuminate from the outer surface 110 of the tube 102, and thereby provide decorative holiday lighting. The lighting members 116*a-c* may include light bulbs having different colors and dimensions. The lighting members 116*a-c* are moved, inserted, and detached from the tube 102 through a pair of open ended tube termini 104*a-b*.

The tube 102 carries the plurality of lighting members 116*a-c* and the accompanying circuitry along its length. The lighting members 116*a-c* protrude through the slot, while the circuitry is protected in the cavity 108 of the tube. The circuitry and the lighting members 116*a-c* insert and detach from the cavity 108 of the tube 102 through a pair of tube termini 104*a-b*, and a slot 106 that runs along the length of the tube 102.

The cavity 108 of the tube 102 enables passage of at least one alignment member 118 for manipulation of the lighting members 116*a-c*. The alignment member 118 attaches to the lighting members 116*a-c* and enables insertion, removal, reorientation, and adjustments of the lighting members 116*a-c* from the tube 102. The alignment member 118 comprises a rod 114 and at least one sphere 120. The rod 114 extends through a cavity of the tube 102, along a longitudinal axis of the tube 102. The rod 114 is flexible and traces the curves of the tube 102 as it is pushed through. The rod 114 does not buckle because it is inside the tube 102.

The at least one sphere 120 forms an integral piece with the rod 114 and attaches to the rod 114 at spaced-apart intervals. The sphere 120 comprises an aperture 122 that enables the rod 114 to pass through. The rod 114 may form a snug fit with the aperture 122, such that the sphere 120 move with the rod 114. In one possible embodiment, a sphere 120 attaches every 12" along the length of the rod 114. In one embodiment, the sphere 120 forms an integrated part of the rod 114. However, in other embodiments, the sphere 120 may be detachably fastened or molded to the rod 114. The sphere 120 rests in the cavity of the tube 102, protruding slightly from a slot 106 that runs along the length of the tube 102.

The lighting members 116*a-c* attach to the sphere 120 with a sphere fastener (not shown), such as zip ties. Though other types of sphere fasteners may be used, including, without limitation, screws, magnets, adhesives, and hook and lop fasteners. In this manner, the lighting members 116*a-c* can be traversed along the length of the tube 102 by pulling and pushing the rod 114 from the pair of open tube termini 104*a-b* at the ends of the tube 102. The rod 114 may also be rotated to orient the lighting members 116*a-c* within the lateral limits of the slot 106. However, in other embodiments, a string is tied at the ends of the rod 114. The string may be used to manipulate the sphere 120; and thereby, the attached lighting member 116*a-c*. As discussed above, the lighting members 116*a-c* are on the outside of the tube 102, while the sphere 120 rests in the cavity 108, protruding slightly from the slot 106.

In some embodiments, a tab 124 extends from the sphere 120. The tab 124 also passes through the slot 106 and helps align the sphere 120 and the attached lighting members

116*a-c* in relation to the tube 102. The tab 124 may be used as a grip for carrying the assembly. In some embodiments, the tab 124 may include a tab gap 126 that is configured to enable rotatable manipulation of the tab 124. In one exemplary embodiment, a string may be tied through the tab gap 126 to manipulate the tab 124, and consequently the sphere 120 that is fastened to the lighting members 116*a-c*.

The assembly 100 further comprises at least one tube fastener 128 and at least one corner tube fastener 140, such as a bracket, of different shapes to which the tube 102 is connected. The corner tube fastener 140 may include a C-shaped bracket for attaching the tube 102 on corners and above edges of the roof. In some embodiments, the tube 102 may also be color coordinated to match the color of the building 200, or the exterior perimeter 202 of the building 200 to which the tube 102 attaches. The safety Holiday light assembly 100 may also be installed around window frames.

Since the tube 102 is generally rigid, loose wiring dos not interfere with installation around the windows. For the same reasons, the assembly 100 could also be installed behind aluminum siding and within exterior surfacing of a building 200. The substantially rigid configuration of the tube 102, and the internally sealed circuitry and lighting member help facilitate installation form the ground surface, and installation to unique sections of the building 200, as described above.

Furthermore, the tube 102 is configured to self-seal by forming barriers at the tube termini 104*a-b*, which generally form open, opposite ends of the tube 102. The tube termini 104*a-b* are configured to enable passage of the rod 114. The tube 102 also forms a seal along a slot 106 that runs along the length of the tube 102. The slot 106 is configured to enable insertion and removal of the rod 114, the at least one sphere 120, and the attached lighting members 116*a-c*.

Through the aforementioned alignment member 118, the lighting members 116*a-c* may be manipulated in a desired orientation within the tube 102 for enhancing the decorative display and for enhancing the seal on the slot 106. The rod 114 is rotated and pulled through the tube 102 to achieve the desired orientation of the spheres 120 and the attached lighting members 116*a*-0*c*. In this manner, the circuitry and lighting members 116*a-c* are protected from external moisture and contaminants, while also displaying enhanced lighting for the holidays.

Figure 2:
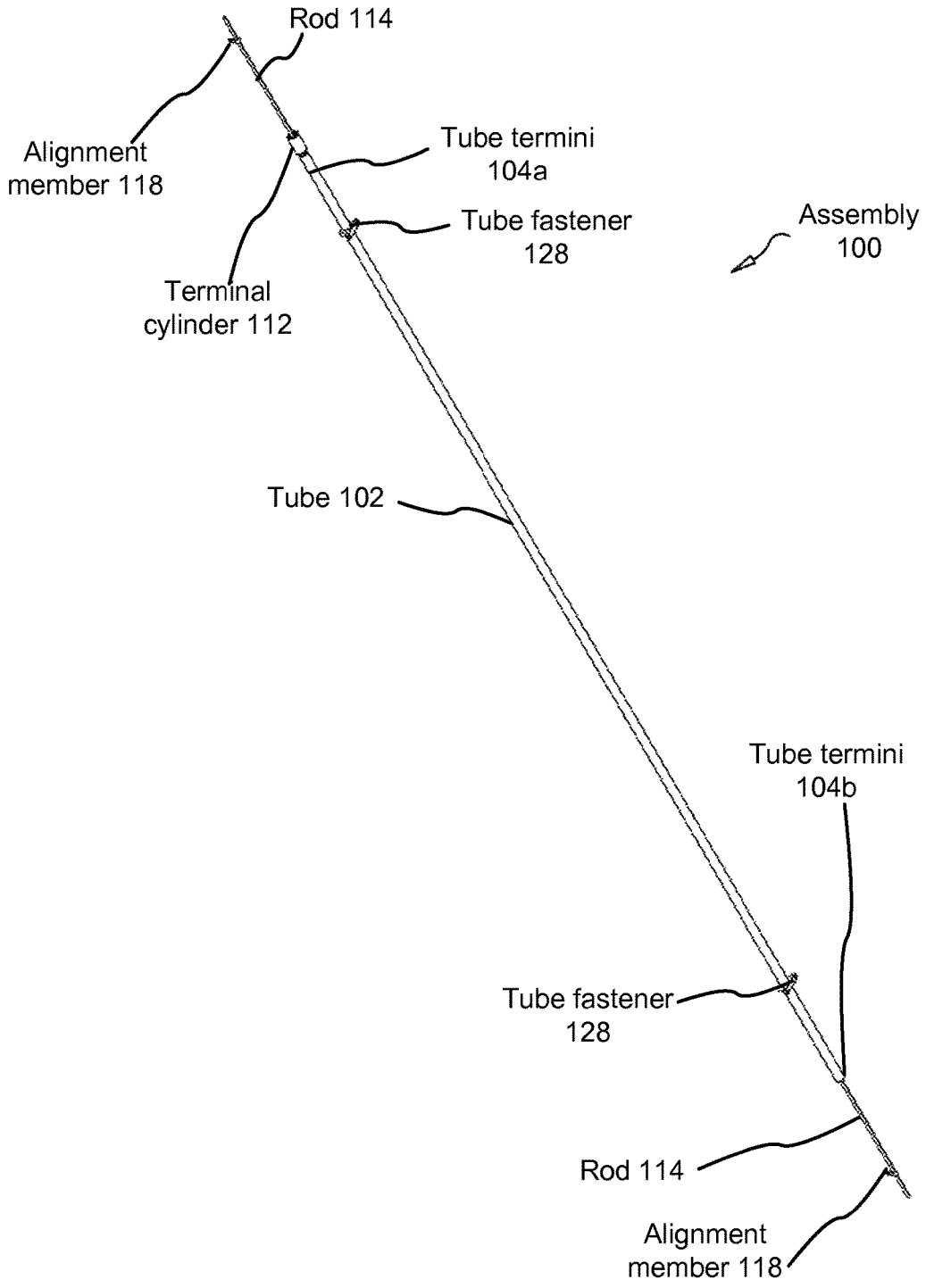
FIG. 2 is a perspective view illustrating a tube with the pair of tube termini and tube fastener in accordance with the present invention.

Turning now to FIG. 2, the assembly 100 comprises a generally elongated tube 102. The tube 102 may be flexible, so as to enable configurations around corners and ridges commonly found at the perimeters 202 of buildings 200. The tube 102 easily and detachably affixes to an exterior perimeter 202 of a building 200 through at least one tube 102 fastener. The tube 102 is configured, chiefly to carry a circuitry and a plurality of lighting members 116*a-c*. The tube 102 is at least partially self-sealed to protect the circuitry and the lighting members 116*a-c* from external elements, such as moisture and contaminants.

Figure 3:
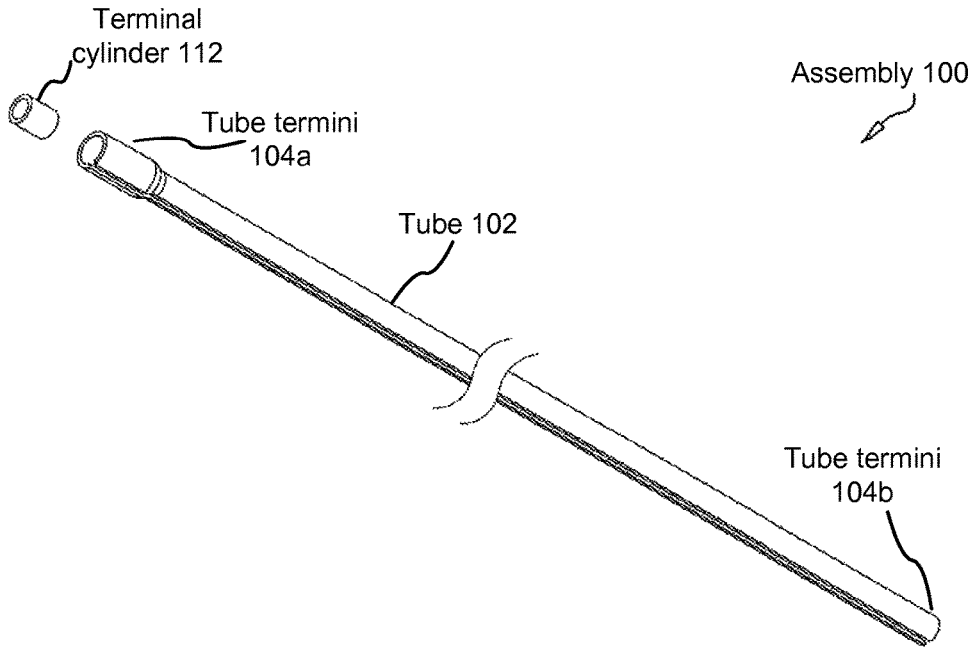
FIG. 3 is a further perspective view illustrating the tube with a detached terminal cylinder in accordance with the present invention.

As referenced in FIG. 3, the assembly 100 comprises a generally elongated and flexible tube 102. The tube 102 is defined by a pair of tube termini 104*a-b*, a cavity 108, an outer surface 110, and a slot 106. The pair of tube termini 104*a-b* are open ends that have a tapered or expanded opening. The pair of tube termini 104*a-b* form openings at the opposite ends of the tube 102, and are defined by a first diameter.

Figure 4:
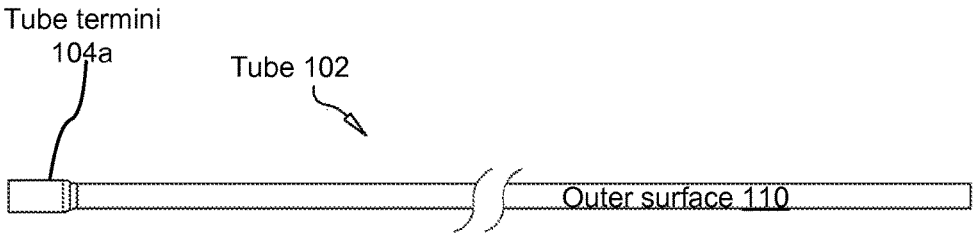
FIG. 4 is a further elevated side view illustrating the tube and a tube terminus in accordance with the present invention.

The cavity 108 is sized and dimensioned to snugly receive the circuitry and a base end of the lighting members 116*a-c*. The outer surface 110 of the tube 102 is sufficiently rigid to enable outdoor installation of the tube 102. The slot 106 forms a space along a substantial length of the tube 102. FIG. 4 illustrates the slot 106 extending along the length of the tube 102 for enabling insertion and removal of a circuitry and a plurality of lighting members 116*a-c*.

Figure 5:
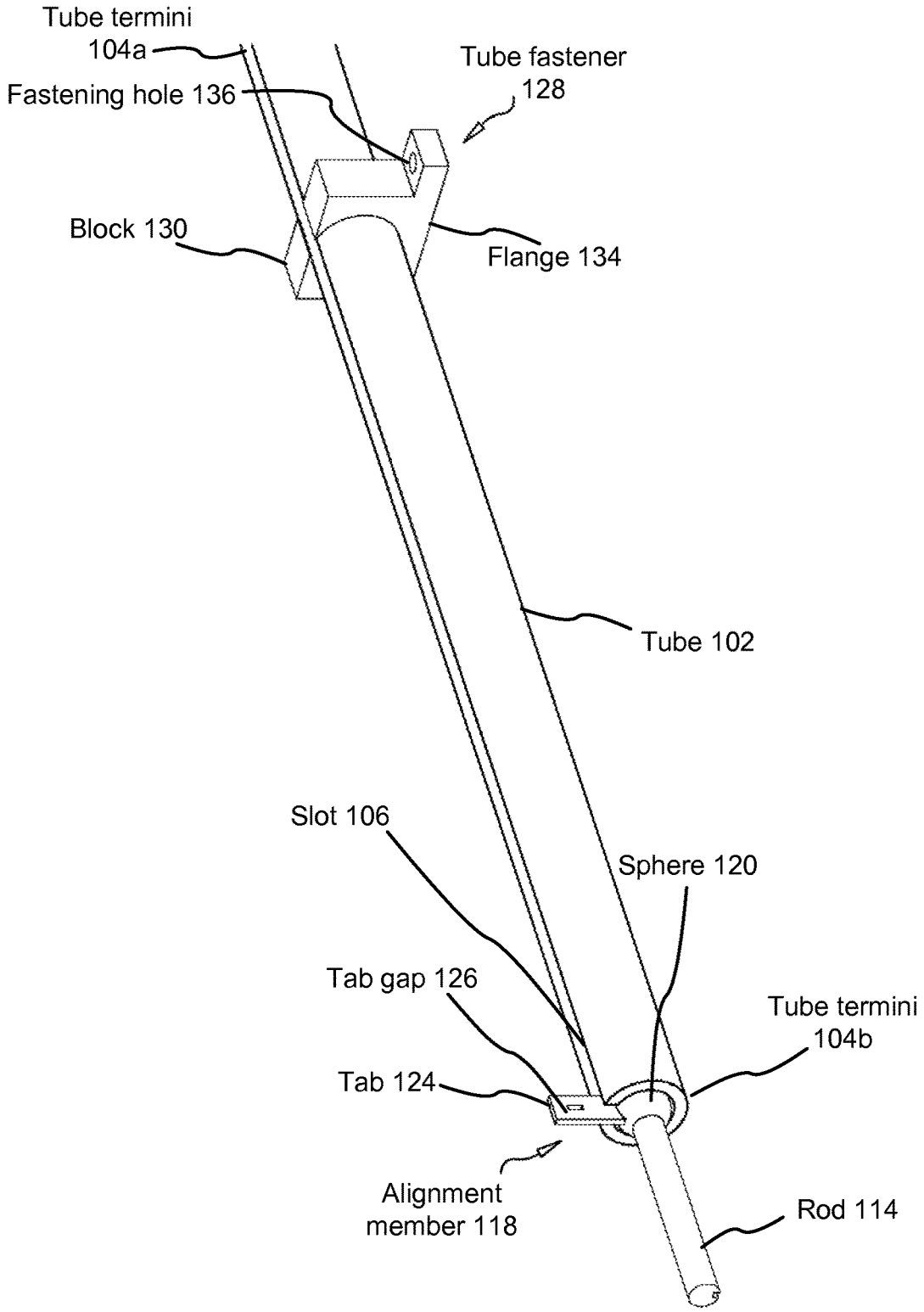
FIG. 5 is a close-up perspective view illustrating one end of the tube with the pair of tube termini and tube fastener in accordance with the present invention.
Figure 6A:
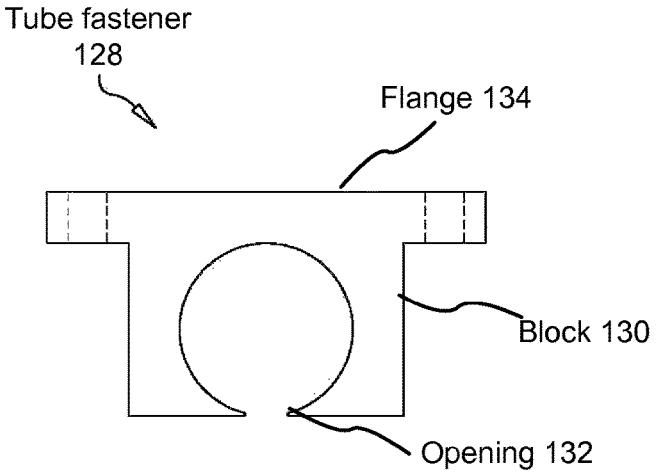
FIGS. 6A, 6B, and 6C are various views illustrating the tube fastener, where

As referenced in FIG. 5, the assembly 100 may further include at least one tube fastener 128 that serves to detachably attach the tube 102 to the exterior perimeter 202 of the building 200. Any configuration of design for the tube 102 may be arranged to achieve a desired decorative effect. The tube fastener 128 comprises a block 130 that holds the tube 102, and a flange 134 that fastens to the building 200 (FIG. 6A). The flange 134 may be attached perpendicularly to the block 130.

Figure 6B:
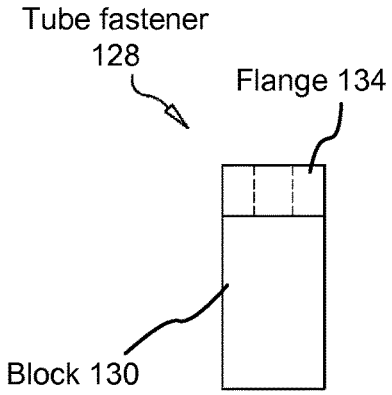
Figure 6C:
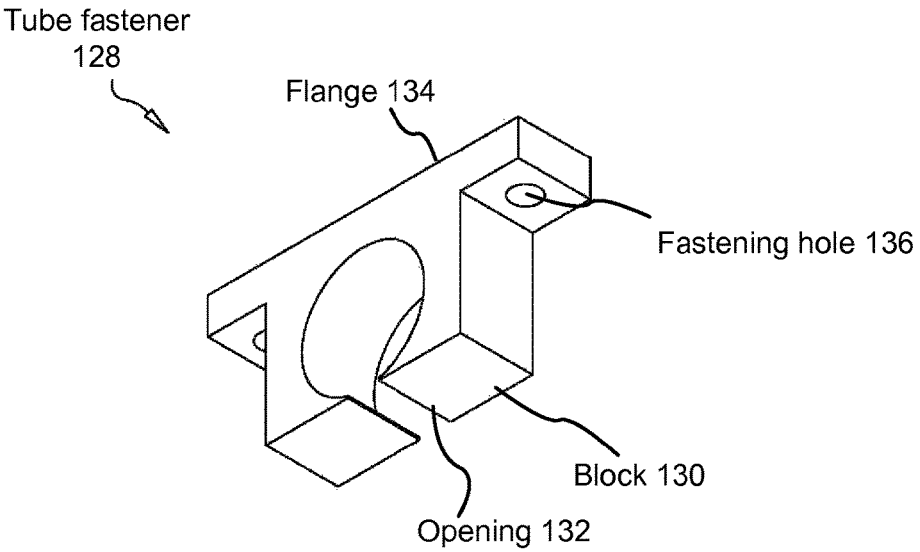

In one embodiment, the block 130 has a centrally disposed opening 132. The opening 132 is configured to enable passage of the tube 102. Thus, the tube 102 may pass through the opening 132 with frictional snugness to the outer surface 110 of the tube 102 (FIG. 6B). The flange 134 mounts on to the building 200. The flange 134 includes at least one fastening hole 136 that enables passage of a fastener, such as a screw or nail, for attaching the tube 102 to the building 200 (FIG. 6C). Though in other embodiments, the flange 134 may attach to the building with a magnet, an adhesive, or a frictional fit.

Figure 7A:
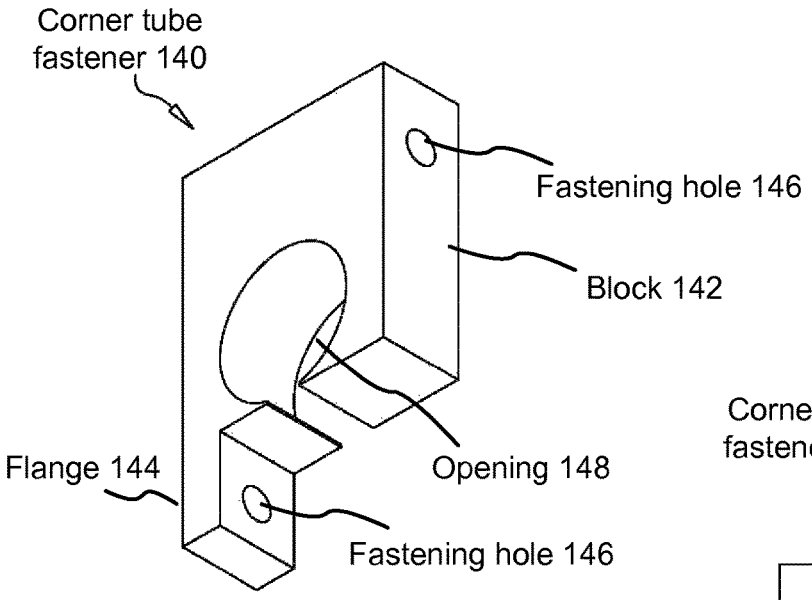
FIGS. 7A, 7B, and 7C are various views illustrating an alternative corner tube fastener, where
Figure 7B:
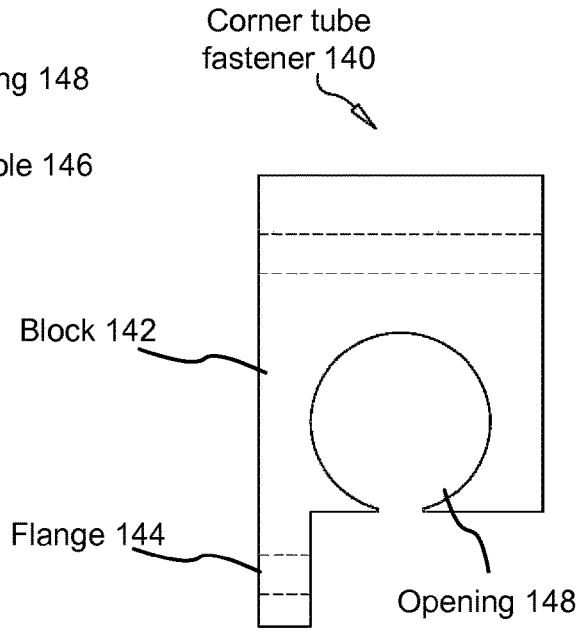
Figure 7C:
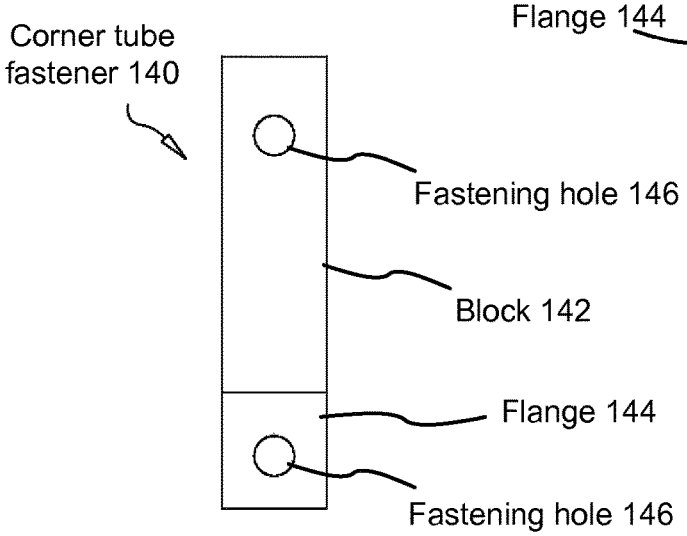

In one alternative embodiment illustrated in FIGS. 7A, 7B, and 7C, the assembly 100 may include a corner tube fastener 140. The corner tube fastener 140 is configured to detachably attach the tube 102 to a corner or awkward angle on the building 200. Those skilled in the art will recognize that Holiday lights are often installed around the full perimeter of a building 200, including the roof. This creates problems since many corners, nooks, and ridges may be encountered. These unique shapes may not be fastened as easily with the generally uniform, rectangular tube fastener 128 discussed above.

In one embodiment of the corner tube fastener 140, an extended flange 144 extends beyond the perimeter 202 of the block 142. Additionally, with the corner tube fastener 140, both the extended flange 144 and the block 142 include at least one fastening hole 146. Similar to the tube fastener 128, the block 142 has an opening 148 for receiving the tube 102.

Figure 8:
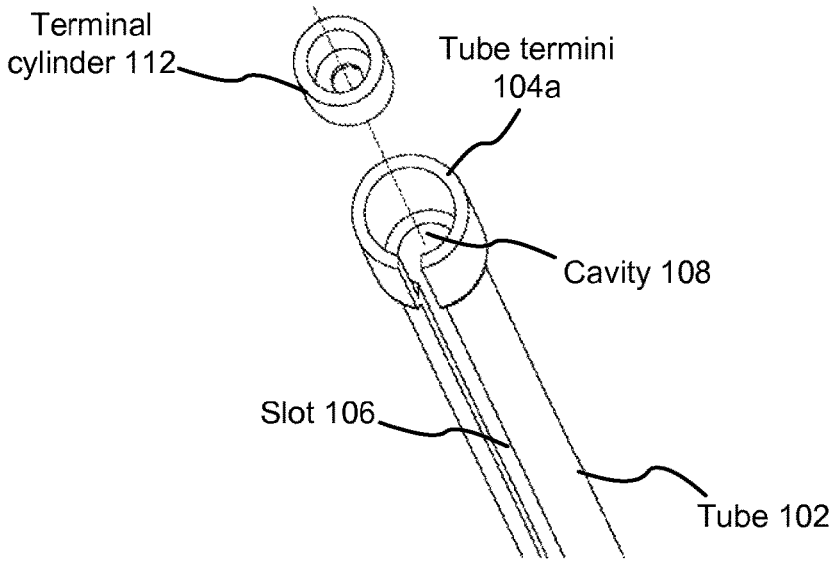
FIG. 8 is a perspective bottom view illustrating one end of the tube in accordance with the present invention.

The assembly 100 may further include at least one terminal cylinder 112 (FIG. 8). The terminal cylinder 112 is configured to detachably couple to the pair of tube termini 104*a-b*, and thus is substantially shaped the same. The terminal cylinder 112 may have a threaded inner surface that rotatably engages the termini 104*a-b* for attachment and detachment therefrom. Though in other embodiments, the terminal cylinder 112 can be attached through frictional fitting or a magnet. The terminal cylinder 112 may include a cylindrically shaped cap with open ends. However, the terminal cylinder 112 may also be closed in some embodiments. The terminal cylinder 112 comprises a second diameter that is generally smaller than the first diameter, such that entry of moisture and contaminants through the pair of tube termini 104*a-b* is at least partially inhibited through this restrictive terminus seal.

Figure 9:
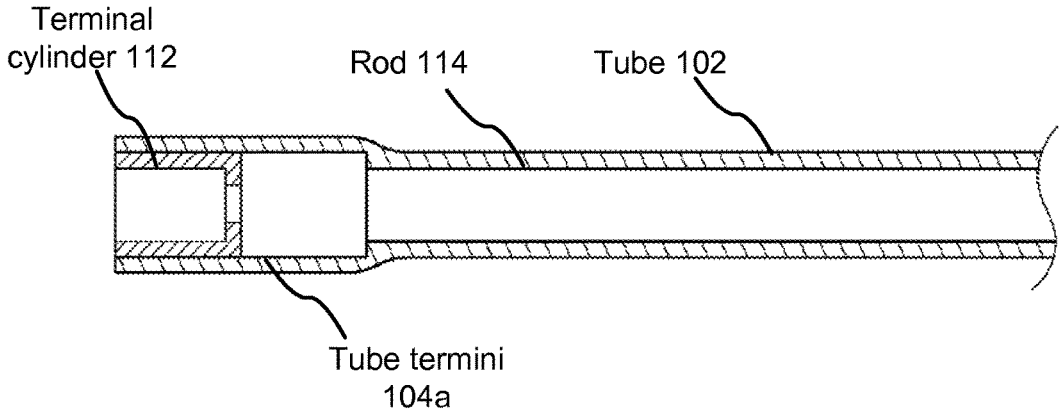
FIG. 9 is a sectioned side view illustrating a tube and a circuitry with the pair of tube termini and tube fastener in accordance with the present invention.

As illustrated in FIGS. 2 and 9, the assembly 100 may further include a circuitry. The circuitry may include a sheathed wire that operatively connects with an external power source 204. The circuitry is configured to carry power for operating the lighting members 116*a-c*. The circuitry is configured to position generally concentric, and in a snug disposition in the cavity 108 of the tube 102. The circuitry is also configured to pass through the slot 106 of the tube 102 for insertion and removal. The circuitry creates a frictional snap action engagement with the slot 106 while passing through, so as to require a force to enable insertion and removal from the tube 102.

The assembly 100 further comprises a plurality of lighting members 116*a-c*, such as light bulbs, light emitting diodes, and light strips. The light bulbs may have a decorative appearance and utilize different colors and multiple lighting patterns known in the art of Holiday decorations. The lighting members 116*a-c* are configured to operatively connect to the circuitry, through connectors, circuitry, and light fixture fittings. In this manner, the lighting members 116*a-c* may convert the power from the circuitry into light. The plurality of lighting members 116*a-c* are sized and dimensioned to at least partially protrude through the slot 106 of the tube 102. In one exemplary embodiment, the circuitry and the lighting members 116*a-c* are held taut against the inner surface of the slot 106, serving as a barrier to moisture and contaminants.

The rod 114 may comprise any rigid or flexible polymeric or metallic material. The rod 114 is affixed to, or formed as an integrated piece with, a plurality of spheres 120. These spheres 120 each comprise a cantilever, or tab 124, which juts or protrudes through the slot 106 and to which holiday lighting may be affixed. In the shown embodiment, the holiday lighting is affixed to the cantilever 124 with ties downs strung through an aperture defined by the cantilever 124.

Figure 10A:
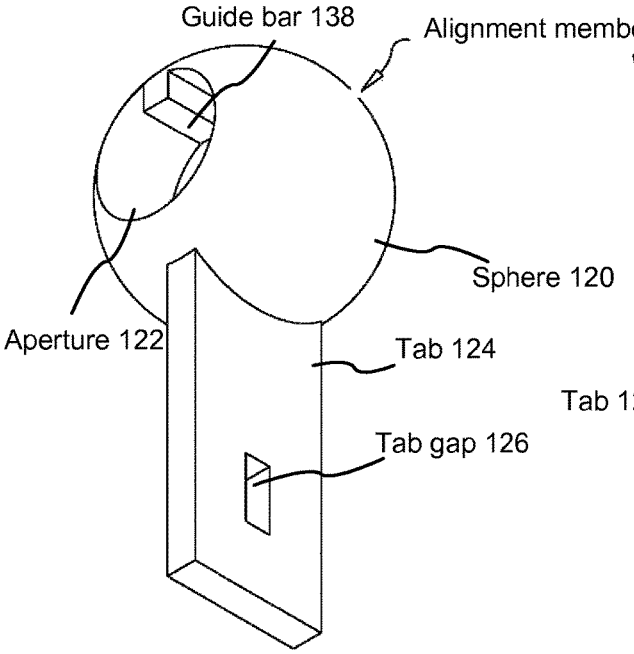
FIGS. 10A, 10B, and 10C are various views illustrating an alignment member, where

Turning now to FIG. 10A, the assembly 100 may include at least one alignment member 118 that enables external manipulation of the lighting members 116*a-c*. The alignment member 118 enables the manipulations for sealing the slot 106 and displaying the lighting members 116*a-c* in a desired orientation. The alignment member 118 is defined by a rod 114 and at least one sphere 120.

Figure 10B:
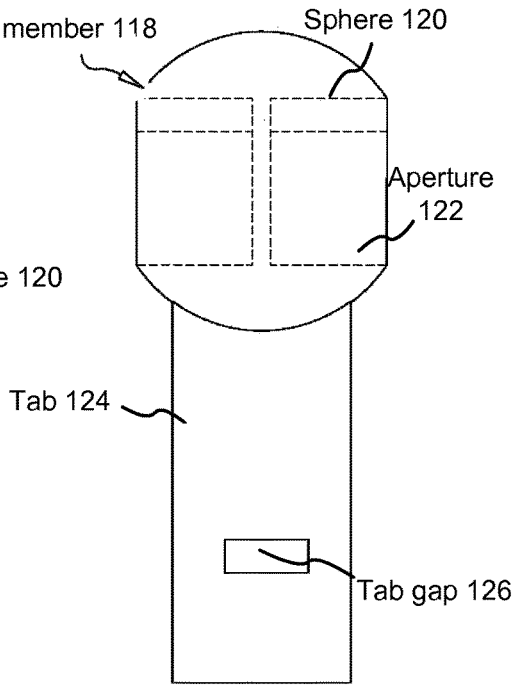
Figure 10C:
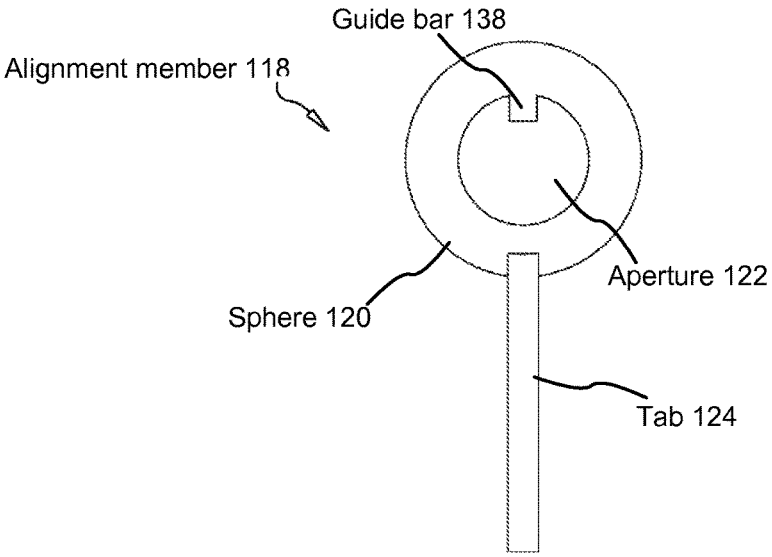

In one embodiment shown in FIG. 10B, the sphere 120 comprises an aperture 122 that is sized and dimensioned to enable passage of the rod 114. The aperture 122 comprises a guide bar 138 that protrudes slightly from an inner ridge of the aperture 122. The guide bar 138 helps manipulate the rod 114 by positioning on one side of the circuitry and through rotation of the sphere 120, rotatably moving the rod 114 inside the tube 102 (FIG. 10C).

Figure 11:
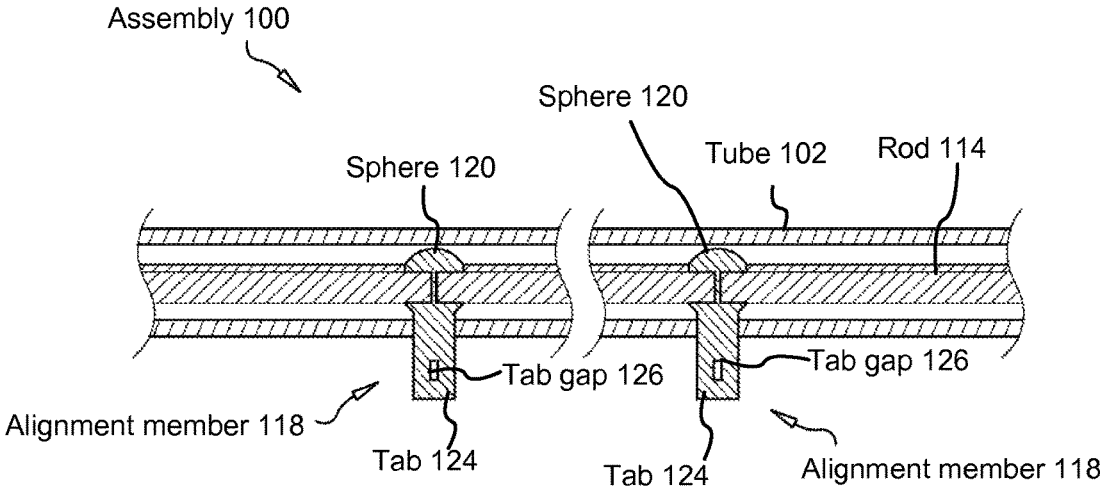
FIG. 11 is a sectioned side view illustrating the alignment member retaining the circuitry in accordance with the present invention.

Looking now at FIG. 11, the tab 124 extends from the sphere 120 and enables control of the sphere 120 from outside the tube 102. In one exemplary embodiment, the tab 124 is moved laterally within the space of the slot 106 to rotate the sphere 120. However, the tab 124, along with the rod 114, may also be used to slide the circuitry along the length of the circuitry. The tab 124 may also be used as a grip for carrying the assembly 100. In some embodiments, the tab 124 may include a tab gap 126 that is configured to enable rotatable manipulation of the tab 124. In one exemplary embodiment, a string may be tied through the tab gap 126 to manipulate the tab 124, and consequently the sphere 120, rod 114, and lighting members 116*a-c*.

In this manner, manipulation of the tab 124 enables rotation of the guide bar 138. And rotation of the guide bar 138 enables rotation of the rod 114 for aligning the plurality of lighting members 116*a-c* through the slot 106 for at least partially sealing the tube 102 and displaying the lighting members 116*a-c* in a desired orientation.

The lighting member 116 may comprise Christmas lights.

Figure 12:
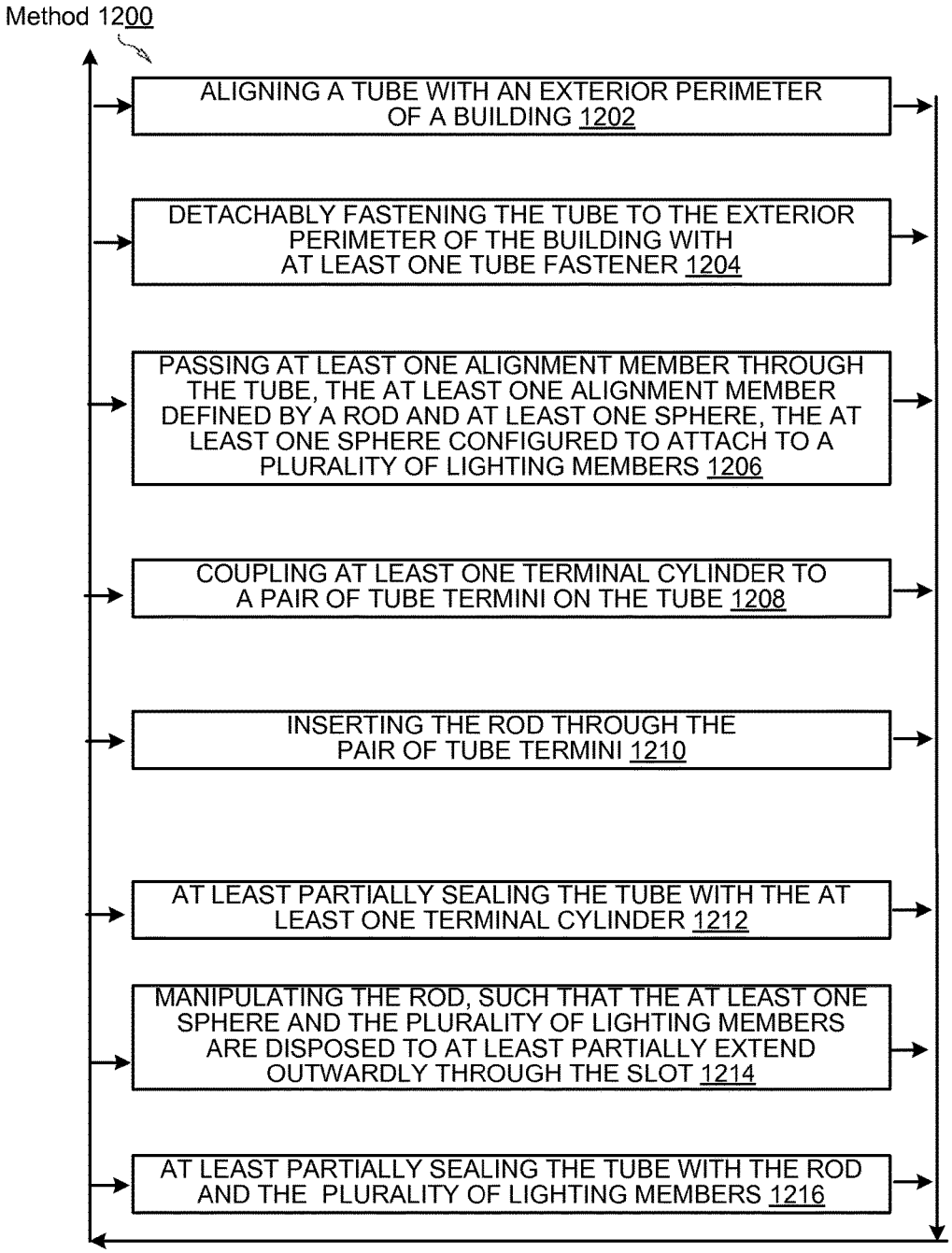
FIG. 12 is a flowchart diagram of a method for sealing a Holiday light assembly while detachably attached to an exterior perimeter of a building in accordance with the present invention.

FIG. 12 shows one possible embodiment of a method 1200 for sealing a holiday light assembly 100 while detachably attached to an exterior perimeter 202 of a building 200.

The method 1200 in the disclosed embodiments substantially includes the steps necessary to carry out the functions presented above with respect to the operation of the described assembly 100. The method 1200 helps protect a circuitry and a plurality of lighting members 116*a-c* from moisture and contaminants by sealing the tube 102. The tube 102 detachably attaches to a perimeter 202 of a building 200 for lighting. At least one terminal cylinder 112 restricts the entrance at the pair of termini 104*a-b* of the tube 102. This inhibits entry of moisture and contaminants from the termini 104*a-b* of the tube 102.

The tube 102 comprises a pair of open termini 104*a-b*, and a slot 106 that enables insertion of an alignment member 118 made up of a rod 114 and at least one sphere 120. The sphere 120 rests in the cavity 108 of the tube. The plurality of lighting members 116*a-c* attach to the sphere 120 and extend out of the tube 102 through the slot 106. The slot 106 is sealed from moisture and contaminants by at least partially filling the slot with the lighting members 116*a-c* and the circuitry.

For example, the lighting members 116*a-c* are rotated and pulled by the rod 114 to at least partially protrude from the slot 106, thereby serving as a seal from external elements. The rod 114 manipulates the lighting members 116*a-c* by being pulled and pushed from its ends. The sphere 120 attaches to the rod 114 inside the tube 102. The sphere 120 is defined by a tab 124 that enables gripping for manipulating the rod 114 and lighting members 116*a-c*.

In one embodiment, the method 1200 includes an initial Step 1202 of aligning a tube 102 with an exterior perimeter 202 of a building 200. The building 200 may include, without limitation, a residential house, an office building 200, and a sky scraper. The tube 102 is defined by a pair of tube termini 104*a-b*, a cavity 108, an outer surface 110, and a slot 106.

The method 1200 also may include a Step 1204 of detachably fastening the tube 102 to the exterior perimeter 202 of the building 200 with at least one tube fastener 128. The tube fastener 128 serves to detachably attach the tube 102 to the exterior perimeter 202 of the building 200. Any configuration of design may be arranged to achieve a desired decorative effect. The tube 102 fastener comprises a block that holds the tube 102 and a generally perpendicular flange that fastens to the building 200.

In a further embodiment, the method 1200 includes a Step 1206 of passing at least one alignment member 118 through the tube 102, the at least one alignment member 118 defined by a rod 114 and at least one sphere 120, the at least one sphere 120 configured to attach to a plurality of lighting members 116*a-c*. The alignment member 118 manipulates the circuitry and the lighting members 116*a-c* for sealing the slot 106 and displaying the lighting members 116*a-c* in a desired orientation. The alignment member 118 attaches directly to the circuitry from a sphere 120, and also extends out of the tube 102 from a tab 124 that enables external manipulation of the circuitry and the lighting members 116*a-c*.

In yet another embodiment, the method 1200 comprises a Step 1208 of coupling at least one terminal cylinder 112 to a pair of tube termini 104*a-b* that form the opposite ends of the tube 102. The terminal cylinder 112 is configured to detachably couple to the tube termini 104*a-b* through a threaded engagement. Though, in other embodiments, frictional fitting, adhesives, and fasteners known in the art may be used to form the connection. The terminal cylinder 112 may include a cylindrically shaped cap with open ends, and be defined by a second diameter. The second diameter is generally smaller than the first diameter, such that entry of moisture and contaminants through the pair of tube termini 104*a-b* is at least partially sealed.

The method 1200 also may include a Step 1210 of inserting the rod 114 through the pair of tube termini 104*a-b*. The rod 114 is configured to pass through the termini 104*a-b*, or even the slot 106 of the tube 102, forming a snap action engagement with the slot 106, such that a force is required to insert or remove the circuitry from the cavity 108 of the tube 102. The rod 114 does not buckle inside the tube 102, since it forms a generally snug fit.

In a further embodiment, the method 1200 includes a Step 1212 of at least partially sealing the tube 102 with the at least one terminal cylinder 112. The terminal cylinder 112 may be threaded to enable threaded engagement with the termini 104*a-b*.

Another Step 1214 of the method 1200 may include manipulating the at least one alignment member 118, such that the rod 114 and the plurality of lighting members 116*a-c* at least partially extend outwardly through the slot 106. Manipulation of the tab 124 enables rotation of the guide bar 138. And rotation of the guide bar 138 enables rotation of the circuitry for aligning the plurality of lighting members 116*a-c* through the slot 106 for at least partially sealing the tube 102 and displaying the lighting members 116*a-c* in a desired orientation. The tab 124 may also be used to manipulate the rod 114. In some embodiments, the tab 124 may include a tab gap 126 that is configured to enable rotatable manipulation of the tab 124. In one exemplary embodiment, a string may be tied through the tab gap 126 to manipulate the tab 124, and consequently the sphere 120, rod 114, and lighting members 116*a-c*.

A final Step 1216 includes at least partially sealing the tube 102 with the circuitry and the plurality of lighting members 116*a-c*. The tab 124 can be pulled, rotated, and slid along the length of the slot 106 to achieve a desired barrier to moisture and contaminants, while also achieving a desired orientation of the lighting members 116*a-c* for decorative holiday lighting.

As described above, the assembly 100 may be installed form a ground surface. The generally lightweight, rigid configuration of the tube 102 enables facilitated manipulation against the exterior perimeter of a building 200, such as an eave, a corner, a roof ridge, a window frame, a window frame, and a door perimeter.

Figure 13:
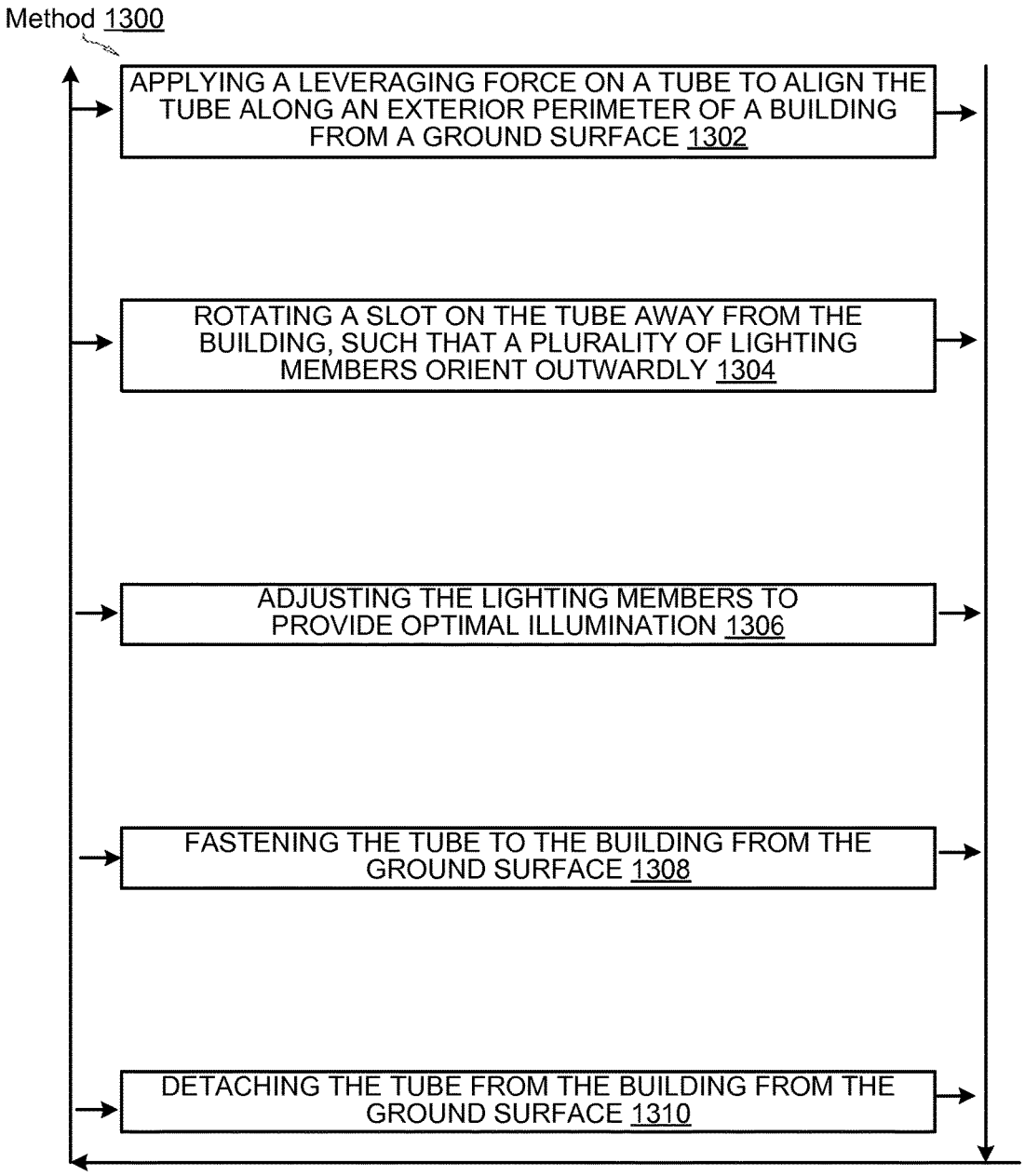
FIG. 13 is a flowchart diagram of a method for installing a Holiday light assembly in accordance with the present invention.

FIG. 13 references an installation method 1300 that enables safe installation of a holiday lighting assembly from a ground surface. In this manner, climbing a ladder or roof of the building to perform the installation is not necessary. The installation method 1300 includes a first Step 1302 of applying a leveraging force on a tube 102 to align the tube 102 along an exterior perimeter of a building from a ground surface. The tube 102 carries a circuitry and a plurality of lighting members 116*a-c* that are used for holiday lighting. The lighting members 116*a-c* protrude through a slot 106 that runs along the length of the tube 102. The tube 102 may be color coordinated to match the colors of the building 200. Furthermore, the tube 102 forms protective seals against external elements at the tube termini 104*a-b* and along a slot 106 that is used to insert and remove the circuitry and lighting members 116*a-c*. The tube 102 acts much like a lever, whereby a fulcrum, such as an arm, can be used to raise the tube 102 against the selected region of the building 200 for installation.

A Step 1304 includes rotating a slot 106 on the tube 102 away from the building, such that a plurality of lighting members 116*a-c* orient outwardly. The lighting members 116*a-c* protrude slightly from the slot 106. The installation method 1300 may further include a Step 1306 of adjusting the lighting members 116*a-c* to provide optimal illumination. Since the lighting members 116*a-c* protrude from the slot, the amount and direction of the lighting members 116*a-c* can be adjusted in this manner. A Step 1308 may include fastening the tube 102 to the building from the ground surface. A fastening device, such as a stapler, a hammer, or a nail gun may be used to fasten screws into the appropriate fastening holes 136 in the tube fastener 128, or even the corner tube fastener 140, as required. A final Step 1310 comprises detaching the tube 102 from the building from the ground surface. The rigid construction of the tube 102 allows for the tube 102 to be pulled off the building 200 from the ground.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A holiday light assembly to facilitate expeditious place of holiday lights on a building, the assembly comprising a plurality of lighting members;

one or more cylindrical tubes defining a hollow inner cavity and a slot, the tubes each having a first diameter and a pair of tube termini, wherein the slot extends along the length of the tube;

an alignment member comprising a rod and a plurality of spheres, the rod and the plurality of spheres joined at evenly spaced-apart intervals, the alignment member disposed to pass through the cavity along the length of the tube, each sphere attaches to a lighting member of the plurality of lighting members wherein each sphere defines an aperture receives the rod and comprises a cantilever protruding through the slot when the alignment member is within the cavity, each cantilever comprising fastening means to fasten the cantilever to the lighting member, wherein each sphere further comprises a guide bar enables rotation of the rod.

2. The assembly of claim 1, further comprising:

at least one terminal cylinder, the at least one terminal cylinder defined by a second diameter, the at least one terminal cylinder configured to detachably couple to the pair of tube termini, at least one tube fastener, the at least one tube fastener defined by a block having an opening, the opening configured to enable passage of the tube, the at least one tube fastener further defined by a flange having at least one fastening hole;

the plurality of lighting member having a plurality of holiday lights.

3. The assembly of claim 2, wherein the block of the at least one tube fastener is affixable to the outer surface of the tube via one of a detachable fastener and adhesive.

4. The assembly of claim 3, wherein the flange of the at least one tube fastener detachably attaches to the exterior perimeter of the building.

5. The assembly of claim 2, wherein the at least one terminal cylinder substantially matches the shape of the pair of tube termini.

6. The assembly of claim 2, wherein the at least one terminal cylinder detachably couples to the pair of tube termini through a threaded engagement.

7. The assembly of claim 2, wherein the at least one fastening hole of the flange is configured to enable passage of a screw.

8. The assembly of claim 1, wherein the rod is affixed to the sphere with adhesive.

9. The assembly of claim 8, wherein the cantilever of each sphere extends outwardly from the cavity of the tube through the slot.

10. The assembly of claim 9, wherein the rod is formed as an integrated piece with the plurality of spheres.

11. The assembly of claim 10, wherein the plurality of lighting members are fastened to the at least one sphere with a fastener.

12. The assembly of claim 11, wherein the tube is configured to detachably attach to an exterior perimeter of a building.

13. The assembly of claim 12, wherein the exterior perimeter of the building includes at least one member selected from the group consisting of: an eave, a corner, a roof ridge, a window frame, and a door perimeter.

14. The assembly of claim 1, wherein the tube is color coordinated to substantially match the exterior perimeter of the building.

15. The assembly of claim 1, wherein the plurality of lighting members includes at least one member selected from the group consisting of: light bulbs, light emitting diodes, and light strips.

16. A method for expeditiously positioning holiday lighting on the exterior perimeter of a building, the method comprising:

aligning a tube with an exterior perimeter of a building;

detachably fastening the tube to the exterior perimeter of the building with at least one tube fastener;

passing at least one alignment member through the tube, the at least one alignment member defined by a rod and at least one sphere, the at least one sphere configured to attach to a plurality of lighting members, wherein the at least one sphere defines an aperture adapted to receive the rod and wherein the at least one sphere comprises a guide rod for enabling rotation of the rod;

coupling at least one terminal cylinder to a pair of tube termini on the tube;

inserting the rod through the pair of tube termini;

at least partially sealing the tube with the at least one terminal cylinder;

manipulating the rod, such that the at least one sphere and the plurality of lighting members are disposed to at least partially extend outwardly through the slot; and at least partially sealing the tube with the rod and the plurality of lighting members.

* * * * *